US008811845B2

(12) United States Patent
Kubota et al.

(10) Patent No.: US 8,811,845 B2
(45) Date of Patent: Aug. 19, 2014

(54) REGISTRATION MARK AND IMAGE FORMING APPARATUS

(75) Inventors: Kousuke Kubota, Kanagawa (JP); Tetsuhiro Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 174 days.

(21) Appl. No.: 13/361,557

(22) Filed: Jan. 30, 2012

(65) Prior Publication Data

US 2013/0064564 A1 Mar. 14, 2013

(30) Foreign Application Priority Data

Sep. 9, 2011 (JP) ..... 2011-197382

(51) Int. Cl.
*G03G 15/00* (2006.01)
*G03G 15/01* (2006.01)

(52) U.S. Cl.
CPC ..... *G03G 15/5033* (2013.01); *G03G 15/0178* (2013.01); *G03G 15/5062* (2013.01); *G03G 2215/00042* (2013.01); *G03G 225/0161* (2013.01)
USPC ..... 399/72; 399/301

(58) Field of Classification Search
CPC ..... G03G 15/01
USPC ..... 399/72, 301
See application file for complete search history.

(56) References Cited

U.S. PATENT DOCUMENTS 5,355,154 A * 10/1994 Guerin ..... 347/116
5,418,556 A * 5/1995 Andrews ..... 346/116
5,909,235 A * 6/1999 Folkins ..... 347/240
6,300,968 B1 * 10/2001 Kerxhalli et al. ..... 347/116
7,324,769 B2 * 1/2008 Yamaoka ..... 399/49
7,689,151 B2 * 3/2010 Katsuhara et al. ..... 399/301
7,778,579 B2 * 8/2010 Ueda et al. ..... 399/301
7,929,892 B2 * 4/2011 Ogawa ..... 399/301
7,941,083 B2 * 5/2011 Suzuki ..... 399/301
8,036,552 B2 * 10/2011 Hashimoto ..... 399/49
8,073,353 B2 * 12/2011 Murayama ..... 399/72
8,090,281 B2 * 1/2012 Hirota et al. ..... 399/49
8,249,477 B2 * 8/2012 Masuda et al. ..... 399/60
8,311,435 B2 * 11/2012 Kushida ..... 399/72
8,340,540 B2 * 12/2012 Gross et al. ..... 399/49
8,385,792 B2 * 2/2013 Miyajima ..... 399/301

(Continued)

FOREIGN PATENT DOCUMENTS

JP 2007-114555 A 5/2007
JP 2010-160317 A 7/2010
JP 4497223 B2 7/2010

*Primary Examiner* — Clayton E Laballe
*Assistant Examiner* — Kevin Butler
(74) *Attorney, Agent, or Firm* — Sughrue Mion, PLLC

(57) ABSTRACT

In a registration mark, when toners of plural colors are divided into two groups of a low-reflectance group having a relatively low spectral reflectance and a high-reflectance group having a relatively high spectral reflectance in accordance with high and low levels of spectral reflectances with respect to light emitted by an optical sensor, a toner pattern that gives information of a toner-image formation position of a toner-image forming unit using the toner that belongs to the low-reflectance group includes a first pattern in which the toner that belongs to the high-reflectance group is distributed without a gap in a moving direction of the transferred member, and second patterns formed with the toner used by the toner-image forming unit, the second patterns being arranged on both sides of the first pattern in the moving direction of the transferred member without a gap with respect to the first pattern.

7 Claims, 11 Drawing Sheets

(56) References Cited

U.S. PATENT DOCUMENTS

| | | | | |
|---|---|---|---|---|
| 8,515,300 | B2 * | 8/2013 | Fuse et al. | 399/49 |
| 2006/0177246 | A1 * | 8/2006 | Kawada et al. | 399/301 |
| 2006/0285863 | A1 * | 12/2006 | Noguchi et al. | 399/49 |
| 2007/0110485 | A1 * | 5/2007 | Katsuhara et al. | 399/301 |
| 2007/0172264 | A1 * | 7/2007 | An | 399/301 |
| 2007/0274745 | A1 * | 11/2007 | Ueda et al. | 399/301 |
| 2009/0080915 | A1 * | 3/2009 | Hashimoto | 399/39 |
| 2010/0080603 | A1 * | 4/2010 | Takahashi | 399/72 |
| 2010/0172662 | A1 * | 7/2010 | Ogawa | 399/39 |
| 2011/0026979 | A1 * | 2/2011 | Murayama | 399/301 |
| 2011/0026982 | A1 * | 2/2011 | Murayama | 399/301 |
| 2011/0097095 | A1 * | 4/2011 | Shirakata | 399/49 |
| 2011/0158668 | A1 * | 6/2011 | Fuse et al. | 399/49 |
| 2011/0229219 | A1 * | 9/2011 | Kobayashi et al. | 399/301 |
| 2011/0318032 | A1 * | 12/2011 | Murayama et al. | 399/49 |
| 2011/0318065 | A1 * | 12/2011 | Shimoda | 399/301 |
| 2012/0163844 | A1 * | 6/2012 | Murayama et al. | 399/49 |
| 2012/0275811 | A1 * | 11/2012 | Sasaki | 399/72 |
| 2013/0064564 | A1 * | 3/2013 | Kubota et al. | 399/72 |
| 2013/0078010 | A1 * | 3/2013 | Inoue et al. | 399/301 |
| 2013/0156472 | A1 * | 6/2013 | Watanabe | 399/301 |

* cited by examiner

REGISTRATION MARK AND IMAGE FORMING APPARATUS

CROSS-REFERENCE TO RELATED APPLICATIONS

This application is based on and claims priority under 35 USC 119 from Japanese Patent Application No. 2011-197382 filed Sep. 9, 2011.

BACKGROUND (i) Technical Field

The present invention relates to a registration mark including a set of toner patterns that give information of toner-image formation positions of plural toner-image forming units, and relates to an image forming apparatus that adjusts the toner-image formation positions by using such a registration mark.

(ii) Related Art

There is known an image forming apparatus that obtains a color toner image by overlaying toner images of plural colors on each other. In many cases, such an image forming apparatus adjusts toner-image formation positions of the toner-image forming units that form toner images of respective colors in order to overlay the toner images with high accuracy. When the current toner-image formation positions are detected for the adjustment, a method using a registration mark including a set of toner patterns formed by the toner-image forming units of the respective colors is frequently employed. With this method, the toner-image formation positions are detected based on a signal acquired when an optical sensor that emits light and receives reflected light radiates the registration mark with light and receives reflected light.

SUMMARY

According to an aspect of the invention, there is provided a registration mark including a set of toner patterns that are formed on a transferred member, which moves along a plurality of toner-image forming units respectively using toners of a plurality of colors and forming a plurality of toner images of different colors and which receives transfer of the plurality of toner images formed by the plurality of toner-image forming units, and that give information of toner-image formation positions of the plurality of toner-image forming units to an optical sensor that emits light and receives reflected light. When the toners of the plurality of colors are divided into two groups of a low-reflectance group having a relatively low spectral reflectance and a high-reflectance group having a relatively high spectral reflectance in accordance with high and low levels of the spectral reflectances with respect to the light emitted by the optical sensor, the toner pattern that gives the information of the toner-image formation position of the toner-image forming unit using the toner that belongs to the low-reflectance group includes a first pattern in which the toner that belongs to the high-reflectance group is distributed without a gap in a moving direction of the transferred member, and second patterns formed with the toner used by the toner-image forming unit, the second patterns being arranged on both sides of the first pattern in the moving direction of the transferred member without a gap with respect to the first pattern.

BRIEF DESCRIPTION OF THE DRAWINGS

Exemplary embodiment(s) of the present invention will be described in detail based on the following figures, wherein.

DETAILED DESCRIPTION

A registration mark and an image forming apparatus according to specific exemplary embodiments of the invention will be described below with reference to the figures.

First, a first exemplary embodiment is described.

Figure 1:
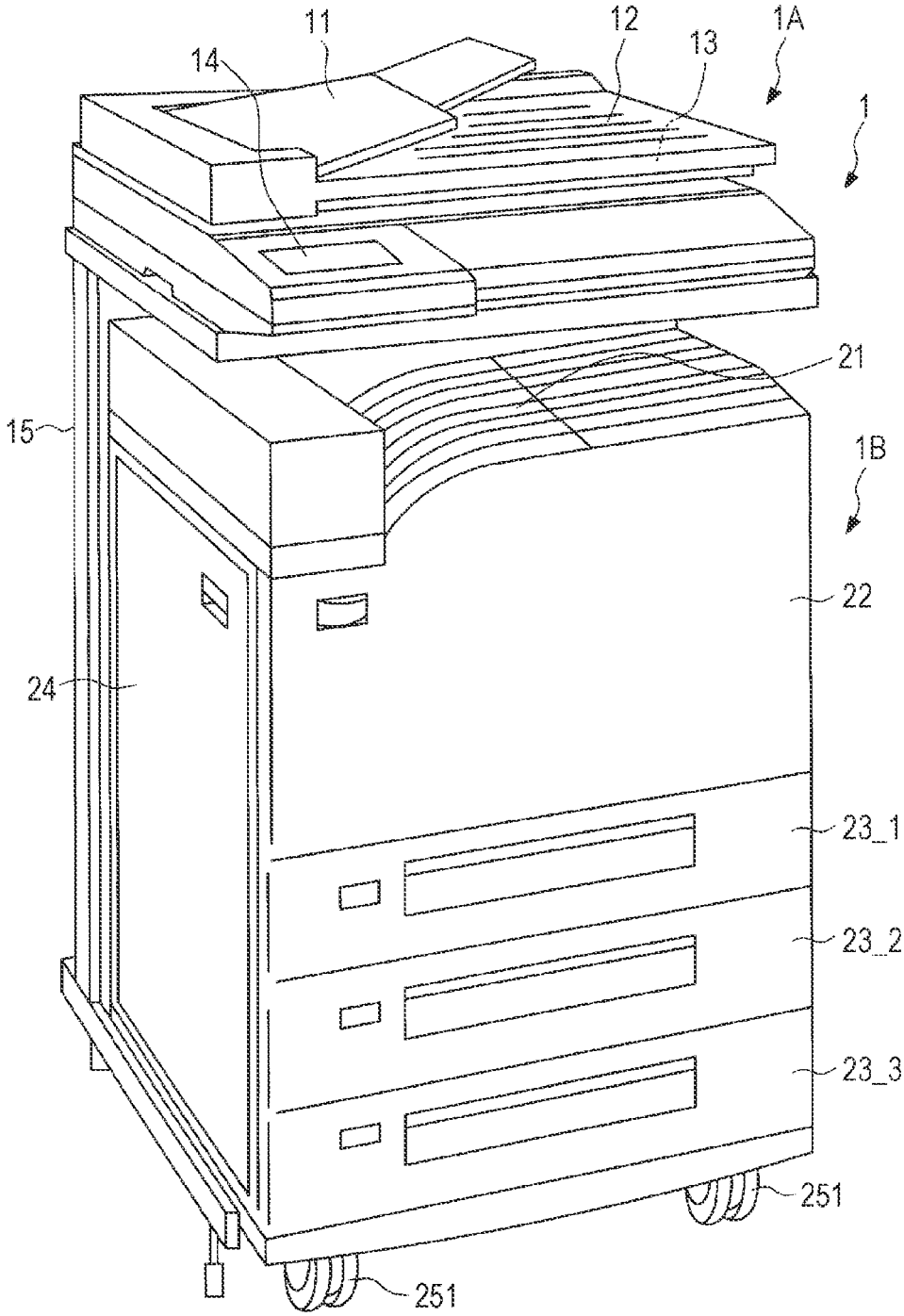
FIG. 1 is an external perspective view of a copier which is an image forming apparatus according to an exemplary embodiment of the present invention.

FIG. 1 is an external perspective view of a copier which is an image forming apparatus according to the first exemplary embodiment of the present invention.

A copier 1 includes a document reading section 1A and an image forming section 1B.

The document reading section 1A includes a document feed tray 11 on which documents are placed in a stacked manner. The documents placed on the document feed tray 11 are fed one by one, a character or an image recorded on the documents is read, and then the documents are output onto a document output tray 12.

The document reading section 1A has a horizontally extending hinge at a far side. The document feed tray 11 and the document output tray 12 may be lifted together around the hinge. A document reading plate 13 (see FIG. 2) made of transparent glass is spread below the document feed tray 11 and the document output tray 12. A single document may be placed on the document reading plate 13 with a surface to be copied facing downward, instead of that a document is placed on the document feed tray 11, and the document reading section 1A may read a character or an image from the document on the document reading plate 13.

A display operation unit 14 is provided at a front side of the document reading plate 13. The display operation unit 14 displays various messages for a user and displays various operation buttons to receive an operation such as an instruction for image reading and an instruction for image formation from the user.

The document reading section 1A is entirely supported by a support frame 15.

The image forming section 1B includes a sheet output tray 21. A sheet with an image formed on an upper surface of the sheet is output onto the sheet output tray 21. A front cover 22 is provided at a front surface of the image forming section 1B. The front cover 22 is opened when a part such as a toner container is replaced or when a paper jam occurring during transportation is cleared. Also, three drawer-type sheet feed trays 23_1, 23_2, and 23_3 are housed below the front cover 22. Sheets before image formation are housed in the sheet feed trays 23_1, 23_2, and 23_3 in a stacked manner.

A side cover 24 is provided at a left surface of the image forming section 1B. The side cover 24 is opened when a paper jam occurring during transportation is cleared.

Further, wheels 251 are attached to a bottom surface of the image forming section 1B. The wheels 251 make the image forming section 1B movable.

Figure 2:
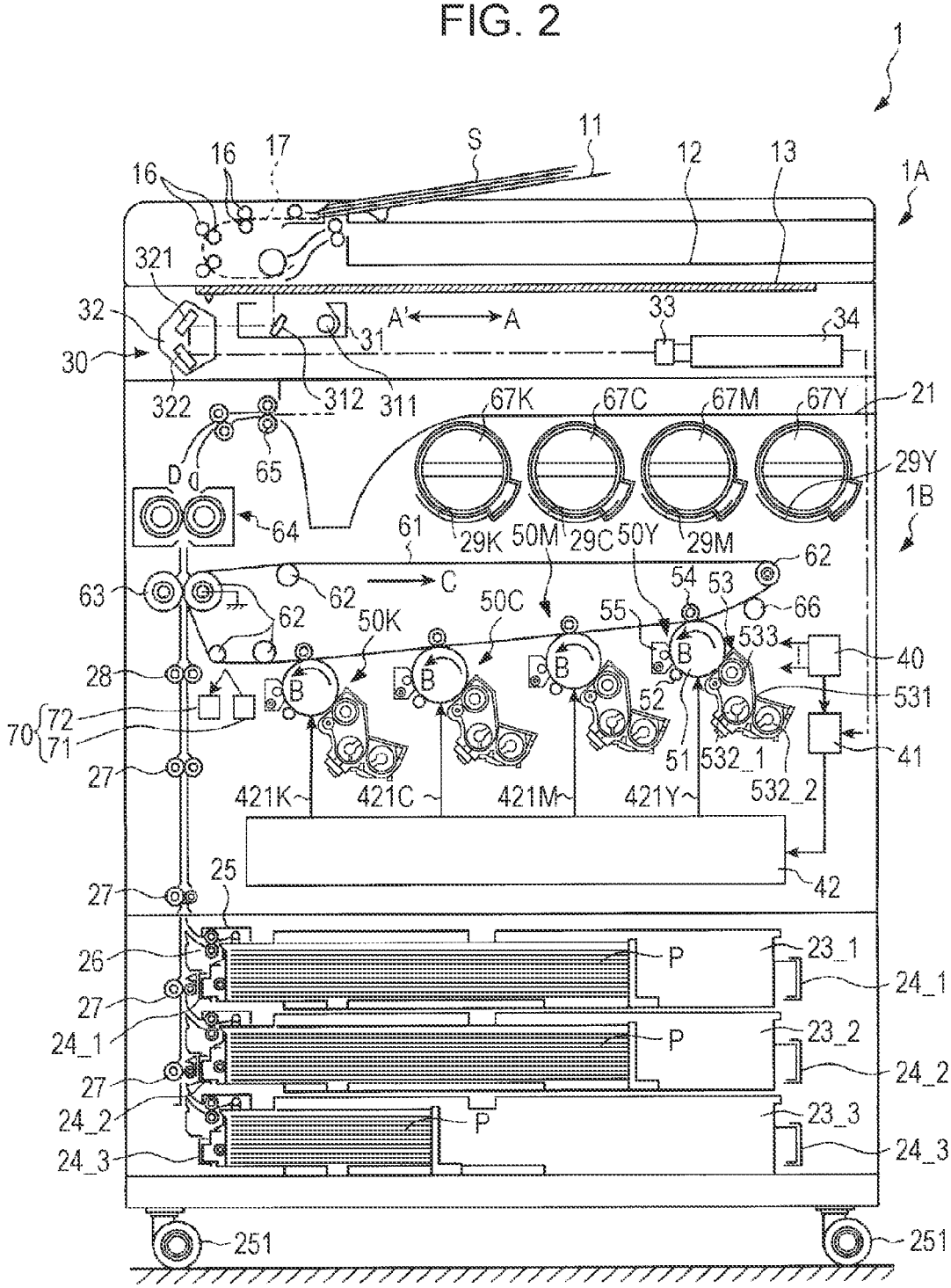
FIG. 2 is an interior configuration diagram of the copier the exterior of which is shown in FIG. 1.

FIG. 2 is an interior configuration diagram of the copier the exterior of which is shown in FIG. 1.

A document reading optical system 30 is arranged below the document reading plate 13 made of transparent glass. The document reading optical system 30 includes a first block 31, a second block 32, and a photoelectric sensor 33. The first block 31 has a lamp 311 and a mirror 312. The second block 32 includes two mirrors 321 and 322. The photoelectric sensor 33 reads light representing an image and generates an image signal.

The first block 31 and the second block 32 are movable in directions indicated by arrows A-A' along the document reading plate 13. In an initial state, the first block 31 and the second block 32 are located at a left position shown in FIG. 2.

Documents S placed on the document feed tray 11 are fed one by one and transported in a transport path 17 that is in contact with the document reading plate 13 by transport rollers 16. The lamp 311 radiates each document S with light when the document S is transported while being in contact with the document reading plate 13. Reflected light from the document S is reflected by the mirrors 312, 321, and 322. The photoelectric sensor 33 reads the reflected light. The photoelectric sensor 33 generates an image signal representing a character or an image recorded on the document S. The document S after radiation by the lamp 311 is further transported onto the document output tray 12.

When a document is placed on the document reading plate 13, the first block 31 and the second block 32 move in the direction indicated by the arrow A such that the optical distance between a reading position of the document on the document reading plate 13 and the photoelectric sensor 33 is kept constant. During the movement, the lamp 311 radiates the document with light, and the photoelectric sensor 33 reads a character or an image on the document and converts the character or the image into image signals.

The image signals acquired by the photoelectric sensor 33 are input to an image processor 34. The image signals acquired by the photoelectric sensor 33 are image signals representing respective colors including red (R), green (G), and blue (B). The image processor 34 converts the RGB image signals into image data of four colors including yellow (Y), magenta (M), cyan (C), and black (K), and temporarily stores the image data. The YMCK image data is transmitted to an exposure controller 41 at a timing of exposure for formation of a latent image (described later).

The image forming section 1B includes an exposure unit 42. When a latent image is formed, the image data of Y, M, C, and K is transmitted from the exposure controller 41 to the exposure unit 42. The exposure unit 42 emits exposure light beams 421Y, 421M, 421C, and 421K that are modulated respectively in accordance with the image data of Y, M, C, and K.

Also, referring to FIG. 2, a main controller 40 is arranged at a position next to the exposure controller 41. The main controller 40 includes a microcomputer and a program executed by the microcomputer. The main controller 40 is connected with the exposure controller 41, the display operation unit 14 (see FIG. 1), the image processor 34, and other power supply circuit and driving circuit (not shown), and provides control for the entire copier 1.

The above-described three sheet feed trays 23_1, 23_2, and 23_3 are housed in a lower portion of the image forming section 1B and supported by left and right guide rails 24_1, 24_2, and 24_3. Sheets P are housed in a stacked manner in each of the sheet feed trays 23_1, 23_2, and 23_3. The sheet feed trays 23_1, 23_2, and 23_3 may be pulled out while being guided by the guide rails 24_1, 24_2, and 24_3 for supply of sheets P.

Sheets P are fed by a pickup roller 25 from a sheet feed tray designated by an operation or the like of the display operation unit 14 (see FIG. 1) from among the three sheet feed trays 23_1, 23_2, and 23_3 (in this case, for example, sheets P are fed from the sheet feed tray 23_1). The sheets P are separated one by one by separation rollers 26 and the separated single sheet P is transported upward by a transport roller 27. A holding roller 28 adjusts the timing of transportation of the sheet P in a path arranged downstream of the holding roller 28. Then, the sheet P is further transported upward. The transportation of the sheet P in the path arranged downstream of the holding roller 28 will be described later.

Four image forming units 50Y, 50M, 50C, and 50K that form toner images with toners of the respective colors including Y, M, C, and K are arranged in a center portion of the image forming section 1B in that order from the right side in the figure. The four image forming units 50Y, 50M, 50C, and 50K correspond to examples of plural toner-image forming units.

The four image forming units 50Y, 50M, 50C, and 50K have equivalent configurations except that the colors of the toners to be used are different. Hence, the configuration of the Y-color image forming unit 50Y is representatively described here.

The image forming unit 50Y includes a photoconductor 51 that rotates in a direction indicated by an arrow B in FIG. 2. A charging device 52, a developing device 53, and a cleaner 55 are arranged around the photoconductor 51. Also, a transfer member 54 is arranged at a position at which an intermediate transfer belt 61 (described later) is arranged between the transfer member 54 and the photoconductor 51.

The photoconductor 51 has a roller-like shape, holds an electric charge by charging, emits the electric charge by exposure, and holds an electrostatic latent image on a surface of the photoconductor 51.

The charging unit 52 charges the surface of the photoconductor 51 with electricity with a certain charge potential.

The image forming section 1B also includes the exposure unit 42 described above. The exposure unit 42 receives the image signals input from the exposure controller 41, and outputs the exposure light beams 421Y, 421M, 421C, and 421K that are modulated in accordance with the input image signals. The photoconductor 51 is charged with electricity by the charging device 52, and then is radiated with the exposure light beam 421Y from the exposure unit 42. Thus, an electrostatic latent image is formed on the surface of the photoconductor 51.

After the electrostatic latent image is formed on the surface of the photoconductor 51 as the result of the radiation with the exposure light beam 421Y, the electrostatic latent image is developed by the developing device 53, and a toner image (in this image forming unit 50Y, a toner image with a toner of yellow (Y)) is formed on the surface of the photoconductor 51.

The developing device 53 includes a case 531 that contains a developer formed of a toner and a carrier therein, two augers 532_1 and 532_2 that stir the developer, and a developing roller 533 that conveys the developer to a position at which the developing roller 533 faces the photoconductor 51. The augers 532_1 and 532_2 and the developing roller 533 are arranged in the case 531. When the electrostatic latent image formed on the photoconductor 51 is developed, a bias voltage is applied to the developing roller 533. The toner in the developer adheres to the electrostatic latent image formed on the photoconductor 51 by the action of the bias voltage, and thus a toner image is formed.

The toner image formed on the photoconductor 51 through the development by the developing device 53 is transferred onto the intermediate transfer belt 61 by the action of the transfer member 54.

The cleaner 55 removes the toner remaining on the photoconductor 51 after the transfer.

The intermediate transfer belt 61 is an endless belt wound around plural rollers 62. The intermediate transfer belt 61 circulates in a direction indicated by an arrow C along the arrangement of the four image forming units 50Y, 50M, 50C, and 50K. The intermediate transfer belt 61 corresponds to an example of a transferred member.

Toner images with toners of the respective colors formed on the image forming units 50Y, 50M, 50C, and 50K are transferred onto the intermediate transfer belt 61 such that the toner images are successively overlaid on each other in order of Y, M, C, and K, and are transported to a second transfer position at which a transfer member 63 is arranged. In synchronization with this, the sheet P transported to the holding roller 28 is transported to the second transfer position. By the action of the transfer member 63, the toner image on the intermediate transfer belt 61 is transferred onto the transported sheet P. The sheet P with the toner image transferred is further transported, and the toner image on the sheet P is fixed to the sheet P by pressure and heat of a fixing device 64. The sheet P having an image formed of the fixed toner image thereon is further transported and output onto the sheet output tray 21 by an output roller 65. The transfer member 63 corresponds to an example of a transfer unit. The fixing device 64 corresponds to an example of a fixing unit.

The intermediate transfer belt 61 after the toner image is transferred onto the sheet P by the transfer member 63 further circulates. A cleaner 66 removes the toner remaining on the surface of the intermediate transfer belt 61.

Also, container mount portions 29Y, 29M, 29C, and 29K are provided above the intermediate transfer belt 61 in the image forming section 1B. Toner containers 67Y, 67M, 67C, and 67K that contain the toners of YMCK colors are mounted on these container mount portions 29Y, 29M, 29C, and 29K. The toners of the respective colors contained in the toner containers 67Y, 67M, 67C, and 67K are supplied to the developing devices 53 in accordance with toner consumption of the developing devices 53.

In the image forming section 1B, the transfer positions of the toner images of the respective colors may be shifted on the intermediate transfer belt 61, because of, for example, vibration or a change in temperature during an operation, or a shift of a mount position of the image forming unit when the image forming unit is replaced.

Owing to this, in the image forming section 1B, the main controller 40 executes registration processing as follows.

The registration processing is processing of adjusting positions of electrostatic latent images on the photoconductors 51 of the image forming units by adjusting timings of radiation with exposure light beams to the photoconductors 51 based on the image data input to the exposure controller 41, so as not to generate a positional shift of the toner images. The function of executing this registration processing by the main controller 40 corresponds to an example of a formation-position adjuster.

To execute the registration processing, adjustment values required for the registration processing are acquired when various phenomena occur, such as when image formation is performed for a predetermined number of sheets, when a temperature-humidity environment is changed, and when a part is replaced. To acquire the adjustment values, a registration mark is used. The registration mark includes toner patterns of plural colors having predetermined shapes and using YMCK colors. When the adjustment values are acquired, the registration mark is transferred onto the intermediate transfer belt 61. Relative positions of the toner patterns included in the registration mark are measured, and current formation positions of the electrostatic latent images on the photoconductors are detected based on the measurement results. Further, adjustment values for next and later registration processing of electrostatic latent images on the photoconductors are acquired based on the detection results.

In the image forming section 1B, an optical sensor 70 is arranged. The optical sensor 70 radiates a position located downstream of the K-color image forming unit 50K and upstream of the transfer member 63 in the moving direction of the intermediate transfer belt 61 with light, receives reflected light, and outputs a signal corresponding to the intensity of the reflected light. The optical sensor 70 includes a light emitting portion 71 that emits light with a wavelength of 940 nm and a light receiving portion 72 that receives reflected light. The light receiving portion 72 is arranged at a position where the light receiving portion 72 receives light emitted from the light emitting portion 71 and reflected by specular reflection from the intermediate transfer belt 61. An output signal of the optical sensor 70 is transmitted to the main controller 40.

The main controller 40 measures the relative positions of the toner patterns, detects the current formation positions of the electrostatic latent images on the photoconductors, and acquires the adjustment values for the next and later registration processing, based on the signal. A combination of the optical sensor 70 and the function of the main controller 40 for detecting the formation positions of the electrostatic latent images corresponds to an example of a formation-position detector.

If a phenomenon required to acquire the adjustment values used for the registration processing occurs, an adjustment-value acquisition request flag is set since process control may not be executed immediately such as during execution of a print operation. Then, the flag is referenced at a timing when the adjustment values may be acquired. When the flag is set, the main controller 40 causes the image forming units 50Y, 50M, 50C, and 50K of YMCK colors to cooperatively form the registration mark on the intermediate transfer belt 61. The main controller 40 also corresponds to an example of a mark formation controller.

After the formation of the registration mark, the optical sensor 70 receives the reflected light and the main controller 40 acquires the adjustment values.

The acquired adjustment values are stored on a memory (not shown). The adjustment values are used for the registration processing when images are formed, until next new adjustment values are acquired.

Figure 3A:
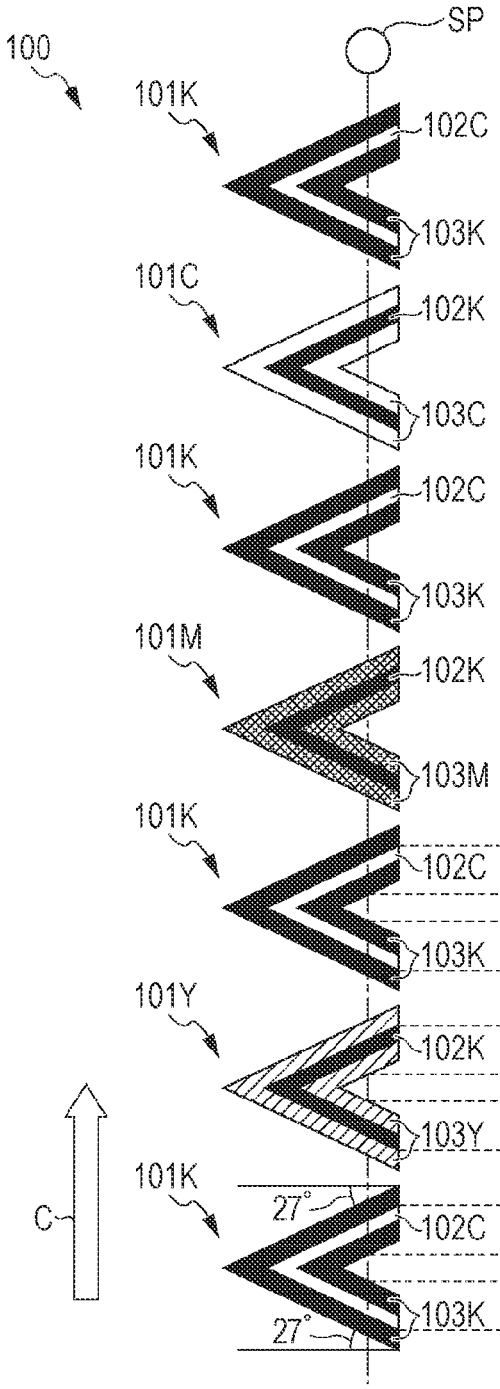
FIGS. 3A to 3C are schematic illustrations showing a registration mark according to an exemplary embodiment of the present invention.
Figures 3B, 3C:
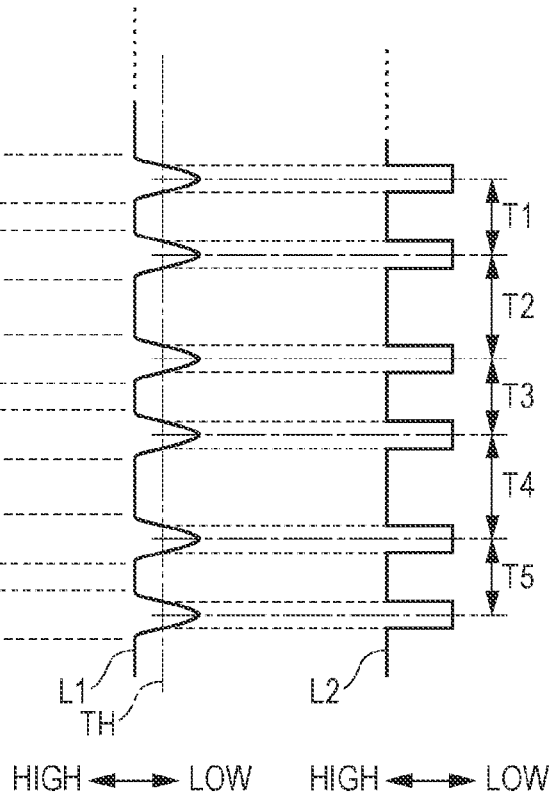

FIGS. 3A to 3C illustrate a registration mark according to the first exemplary embodiment.

FIG. 3A illustrates a registration mark 100.

The registration mark 100 according to the first exemplary embodiment includes toner patterns 101Y, 101M, 101C, and 101K of YMCK colors. The toner patterns 101Y, 101M, 101C, and 101K have equivalent shapes. In particular, the toner patterns each have a shape in which a strip-like pattern inclined upward to the right and a strip-like pattern inclined downward to the right are connected with each other at the left in the figure in a form of a protruding arrowhead.

FIG. 3A illustrates the arrow C (also shown in FIG. 2) as an arrow indicative of the moving direction of the intermediate transfer belt 61. In the first exemplary embodiment, an inclination angle of each of the two arms included in the arrowhead-like toner pattern is 27° with respect to a left-right direction in the figure orthogonal to the moving direction indicated by the arrow C.

The toner patterns 101Y, 101M, and 101C of three YMC colors are arranged in line from the downstream side to the upstream side in the moving direction of the intermediate transfer belt 61 indicated by the arrow C in order of YMC. Also, the K-color toner patterns 101K are arranged at positions such that each of the toner patterns 101Y, 101M, and 101C is arranged between the toner patterns 101K from both sides in the moving direction indicated by the arrow C.

In FIG. 3A, for simplifying the illustration, the single toner pattern 101Y, the single toner pattern 101M, and the single toner pattern 101C of YMC colors are illustrated. The registration mark 100 according to the first exemplary embodiment includes plural toner patterns 101Y, plural toner patterns 101M, and plural toner patterns 101C of YMC colors. Each Y-color toner pattern 101Y is arranged between the K-color toner patterns 101K, each M-color toner pattern 101M is arranged between the K-color toner patterns 101K, and each C-color toner pattern 101C is arranged between the K-color toner patterns 101K.

The K-color toner pattern 101K includes an inner pattern 102C formed with the C-color toner and outer patterns 103K formed with the K-color toner. The C-color inner pattern 102C is formed such that the C-color toner is distributed without a gap in the moving direction indicated by the arrow C. The K-color outer patterns 103K are arranged on both sides of the C-color inner pattern 102C without a gap with respect to the C-color inner pattern 102C in the moving direction indicated by the arrow C.

Also, the Y-color toner pattern 101Y includes an inner pattern 102K formed with the K-color toner and an outer pattern 103Y formed with the Y-color toner. The K-color inner pattern 102K is formed such that the K-color toner is distributed without a gap in the moving direction indicated by the arrow C. The Y-color outer pattern 103Y is arranged on both sides of the K-color inner pattern 102K without a gap with respect to the K-color inner pattern 102K in the moving direction indicated by the arrow C.

Also, the M-color toner pattern 101M includes the inner pattern 102K formed with the K-color toner and an outer pattern 103M formed with the M-color toner. The M-color outer pattern 103M is arranged on both sides of the K-color inner pattern 102K without a gap with respect to the K-color inner pattern 102K in the moving direction indicated by the arrow C.

Also, the C-color toner pattern 101C includes the inner pattern 102K formed with the K-color toner and an outer pattern 103C formed with the C-color toner. The C-color outer pattern 103C is arranged on both sides of the K-color inner pattern 102K without a gap with respect to the K-color inner pattern 102K in the moving direction indicated by the arrow C.

In the first exemplary embodiment, all the toner patterns 101Y, 101M, 101C, and 101K of YMCK colors have the inner patterns. Alternatively, only the K-color toner pattern may have the inner pattern, and the toner patterns of the other YMC colors may be respectively formed with only the toners of YMC colors.

Also, in the first exemplary embodiment, the K-color toner pattern 101K has the C-color inner pattern 102C. Alternatively, the K-color toner pattern may have the Y-color inner pattern. Still alternatively, the K-color toner pattern may have the M-color inner pattern.

Also, in the first exemplary embodiment, each of the toner patterns of YMC colors is arranged between the K-color toner patterns 101K. Alternatively, the registration mark may have an arrangement in which the toner patterns of YMCK colors are simply arranged in that order as a set and plural sets are arranged.

In the first exemplary embodiment, the registration mark 100 is formed on the intermediate transfer belt 61. When the intermediate transfer belt 61 moves in the moving direction indicated by the arrow C, a spot SP of light emitted from the light emitting portion 71 of the optical sensor 70 shown in FIG. 2 passes across the toner patterns on the intermediate transfer belt 61. Then, the light receiving portion 72 receives reflected light reflected from the surface of the intermediate transfer belt 61 and the toner patterns.

In the first exemplary embodiment, a reflectance by specular reflection at the surface of the intermediate transfer belt 61 is higher than a reflectance by specular reflection at the toner image formed on the surface of the intermediate transfer belt 61. Hence, if the spot SP passes across the toner patterns, the intensity of reflected light received by the light receiving portion 72 decreases.

FIG. 3B schematically illustrate a signal in the form of a first line L1 output by the light receiving portion 72 when the light receiving portion 72 receives reflected light. In FIG. 3B, a signal level decreases toward the right in the figure.

As described above, each toner pattern has an arrowhead-like shape and has two arms such that an interval between the arms increases toward the right in the figure. As indicated by the first line L1, the signal level of the output signal of the light receiving portion 72 decreases when the spot SP passes through a position above each arm of the toner patterns.

The output signal is input to the main controller 40 shown in FIG. 2, is binarized through comparison with a threshold TH that is ½ of a peak value at which a decrease is the largest, and is converted into a pulsed signal indicated by a second line L2 in FIG. 3C. In FIG. 3C, a signal level decreases toward the right in the figure. Each pulse appearing in the pulsed signal corresponds to each of the two arms of each toner pattern. The main controller 40 acquires the adjustment values for the formation positions of the electrostatic latent images used for the registration processing, based on a pulse interval of the pulsed signal acquired by the binarization.

In the first exemplary embodiment, a position corresponding to a toner-image formation position on the photoconductor 51 of the K-color image forming unit 50K serves as a reference position for toner-image formation positions on the photoconductors 51 of the image forming units 50Y, 50M, and 50C of YMC colors shown in FIG. 2. Then, adjustment values are acquired for correcting shifts of the toner-image formation positions on the photoconductors 51 of the image forming units 50Y, 50M, and 50C of YMC colors with respect to the reference position.

For K color, since the K-color toner-image formation position serves as the reference for the toner-image formation positions of the respective colors, the adjustment value is constantly "0."

By the registration processing using such adjustment values, the toner images of YMC colors are overlaid on the K-color toner image on the intermediate transfer belt 61. That is, the toner images of all YMCK colors are overlaid on each other.

The first exemplary embodiment provides the example configuration that acquires the adjustment values for the toner-image formation positions on the photoconductors 51 of the image forming units 50Y, 50M, and 50C of YMC colors by using the position corresponding to the toner-image formation position on the photoconductor 51 of the K-color image forming unit 50K as the reference position. Alternatively, adjustment values may be acquired by using a position corresponding to the toner-image formation position on the photoconductor of the image forming unit of a color other than K color as the reference position. Still alternatively, an adjustment value may not be acquired for correcting a shift from such a reference position, and an adjustment value may be acquired for correcting a shift from a position corresponding to a next toner-image formation position on a photoconductor of a certain image forming unit.

A method of acquiring an adjustment value according to the first exemplary embodiment is common among YMC colors. Hence, for example, acquisition of a Y-color adjustment value is described.

To acquire the Y-color adjustment value, five pulse intervals are used as follows.

A first pulse interval T1 is a pulse interval between two pulses corresponding to the K-color toner pattern 101K arranged above the Y-color toner pattern 101Y in the figure.

A second pulse interval T2 is a pulse interval between an upper pulse in the figure from among pulses corresponding to the Y-color toner pattern 101Y and a lower pulse in the figure from among the pulses corresponding to the K-color toner pattern 101K arranged above the Y-color toner pattern 101Y in the figure.

A third pulse interval T3 is a pulse interval between two pulses corresponding to the Y-color toner pattern 101Y.

A fourth pulse interval T4 is a pulse interval between a lower pulse in the figure from among the pulses corresponding to the Y-color toner pattern 101Y and an upper pulse in the figure from among pulses corresponding to the K-color toner pattern 101K arranged below the Y-color toner pattern 101Y in the figure.

A fifth pulse interval T5 is a pulse interval between the two pulses corresponding to the K-color toner pattern 101K arranged below the Y-color toner pattern 101Y in the figure.

A positional shift of the Y-color toner-image formation position includes a positional shift in a main-scanning direction along a rotation axis of the photoconductor 51 (see FIG. 2) and a positional shift in a sub-scanning direction along a rotating direction of the photoconductor 51.

If the Y-color toner-image formation position is shifted from the above-described reference position in the main-scanning direction, the Y-color toner pattern 101Y is shifted from the K-color toner pattern 101K in a direction orthogonal to the moving direction of the intermediate transfer belt 61 (the direction indicated by the arrow C in FIG. 3A). Such a positional shift between toner patterns appears as a difference between the third pulse interval T3 and the first pulse interval T1 or a difference between the third pulse interval T3 and the fifth pulse interval T5.

Hence, in the first exemplary embodiment, a value L indicative of a positional shift amount of the toner-image formation position in the main-scanning direction is calculated by using Expression (1) as follows:

$$L=T3-(T1+T5)/2 \quad (1).$$

When the registration mark 100 used for the calculation of the value L indicative of the positional shift in the main-scanning direction is formed, the registration processing using the adjustment value currently stored on the memory (not shown) is used. The positional shift amount indicated by the value L calculated with Expression (1) is a positional shift amount in the main-scanning direction that is present because the shift is not completely adjusted even by the registration processing.

Owing to this, when the value L indicative of the positional shift amount in the main-scanning direction is calculated, the main controller 40 shown in FIG. 2 corrects the current adjustment value in the main-scanning direction such that the toner-image formation position is shifted in a direction opposite to the direction of the positional shift with the amount indicated by the value L, and hence acquires a new adjustment value in the main-scanning direction.

If the Y-color toner-image formation position is shifted from the above-described reference position in the sub-scanning direction, the Y-color toner pattern 101Y is shifted from the K-color toner pattern 101K in the moving direction of the intermediate transfer belt 61 (the direction indicated by the arrow C in FIG. 3A). In this case, a difference is generated between the interval of the Y-color toner pattern 101Y and the K-color toner pattern 101K arranged above the Y-color toner pattern 101Y in the figure and the interval of the Y-color toner pattern 101Y and the K-color toner pattern 101K arranged below the Y-color toner pattern 101Y in the figure.

In the first exemplary embodiment, (T1/2+T2) is employed as a value indicative of an interval between the Y-color toner pattern 101Y and the K-color toner pattern 101K arranged above the Y-color toner pattern 101Y in the figure. Also, (T5/2+T4) is employed as a value indicative of an interval between the Y-color toner pattern 101Y and the K-color toner pattern 101K arranged below the Y-color toner pattern 101Y in the figure. Then, a value P indicative of a positional shift amount of the toner-image formation position in the sub-scanning direction is calculated by using Expression (2) as follows:

$$P=(T1/2+T2)-(T5/2+T4) \quad (2).$$

When the value P indicative of the positional shift amount in the sub-scanning direction is calculated, the main controller 40 shown in FIG. 2 corrects the current adjustment value in the sub-scanning direction such that the toner-image formation position is shifted in a direction opposite to the direction of the positional shift with the amount indicated by the value P, and hence acquires a new adjustment value in the sub-scanning direction.

New adjustment values for MC colors are acquired by the same acquisition method as that of Y color.

The adjustment values on the memory (not shown) are updated by the newly acquired adjustment values. The new adjustment values are used for the registration processing until next new adjustment values are acquired.

In the first exemplary embodiment, the adjustment values of YMC colors are calculated by using the pulse intervals relating to the two K-color toner patterns arranged on both sides of each of the toner patterns of YMC colors. Alternatively, each of the adjustment values of YMC colors may be calculated by using a pulse interval relating to a single K-color toner pattern next to each of the toner patterns of YMC colors.

In general, toner images formed with toners of YMCK colors have spectral reflectances as follows.

Figure 4:
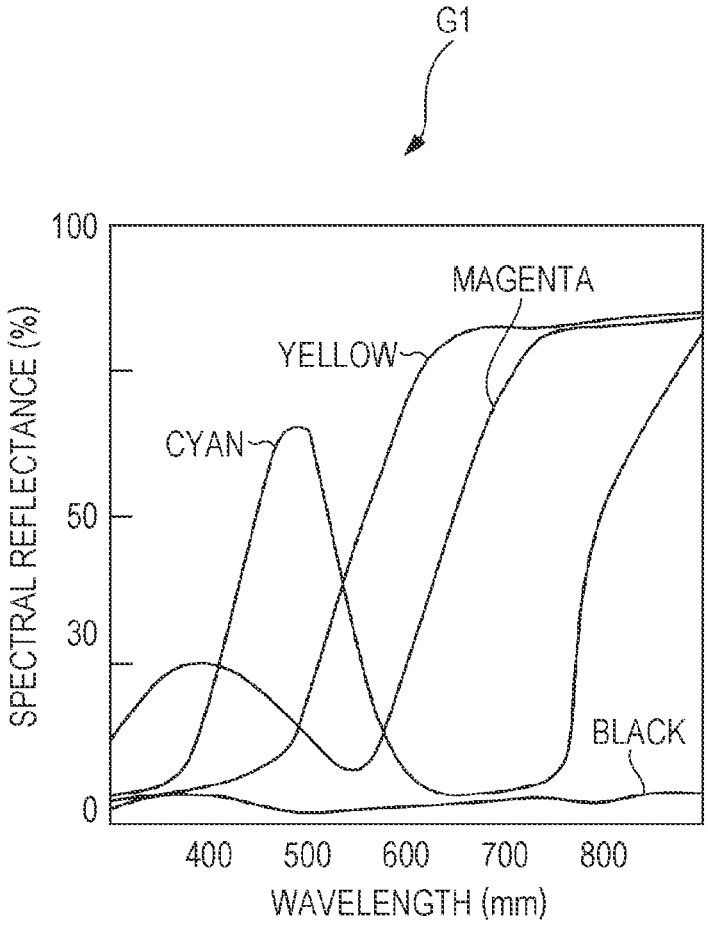
FIG. 4 is a graph showing a change in spectral reflectance of a toner image formed with each of toners of YMCK colors with respect to a wavelength of light.

FIG. 4 is a graph showing a change in spectral reflectance of a toner image formed with each of toners of YMCK colors with respect to a wavelength of light.

In a graph G1 shown in FIG. 4, the horizontal axis plots a wavelength of light and the vertical axis plots a spectral reflectance. The graph G1 has curves each indicative of a change in spectral reflectance with respect to a wavelength of light, for a toner image formed with a toner of each of YMCK colors.

In the first exemplary embodiment, a wavelength of light emitted from the light emitting portion 71 of the optical sensor 70 shown in FIG. 2 is 940 nm as described above. As it is found from the graph G1 shown in FIG. 4, the toner images of three YMC colors have relatively high spectral reflectances with respect to the light with the wavelength of 940 nm. In contrast, the K-color toner image has a relatively low spectral reflectance with respect to the light with the wavelength of 940 nm. Hence, in the first exemplary embodiment, the toners of three YMC colors that form the toner images having the relatively high spectral reflectances each correspond to an example of a toner that belongs to a high-reflectance group. The remaining K-color toner corresponds to an example of a toner that belongs to a low-reflectance group.

The K-color toner pattern 101K shown in FIG. 3A has a pattern structure in which the K-color outer patterns 103K having the relatively low spectral reflectance are arranged on both sides in the moving direction indicated by the arrow C of the C-color inner pattern 102C having the relatively high spectral reflectance. The C-color inner pattern 102C corresponds to an example of a first pattern. The K-color inner pattern 103K corresponds to an example of a second pattern.

The Y-color toner pattern 101Y has a pattern structure in which the Y-color outer pattern 103Y having the relatively high spectral reflectance is arranged on both sides in the moving direction indicated by the arrow C of the K-color inner pattern 102K having the relatively low spectral reflectance.

The M-color toner pattern 101M has a pattern structure in which the M-color outer pattern 103M having the relatively high spectral reflectance is arranged on both sides in the moving direction indicated by the arrow C of the K-color inner pattern 102K having the relatively low spectral reflectance.

The C-color toner pattern 101C has a pattern structure in which the C-color outer pattern 103C having the relatively high spectral reflectance is arranged on both sides in the moving direction indicated by the arrow C of the K-color inner pattern 102K having the relatively low spectral reflectance.

The K-color inner pattern 102K corresponds to an example of a third pattern. The outer patterns 103Y, 103M, and 103C of YMC colors each correspond to an example of a fourth pattern.

In the first exemplary embodiment, the width of each of the two arms included in each of the toner patterns of YMCK colors is determined based on an experiment described below.

Figure 5A:
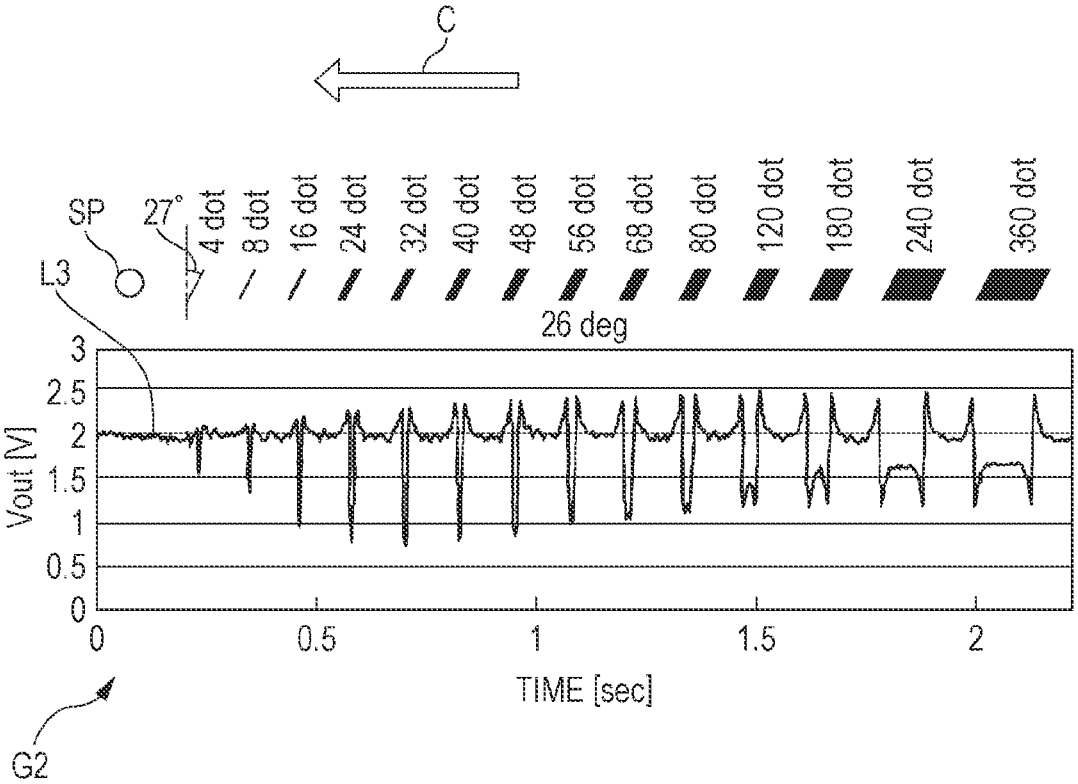
FIGS. 5A and 5B are illustrations explaining an experiment for determining a width of two arms included in a toner pattern.
Figure 5B:
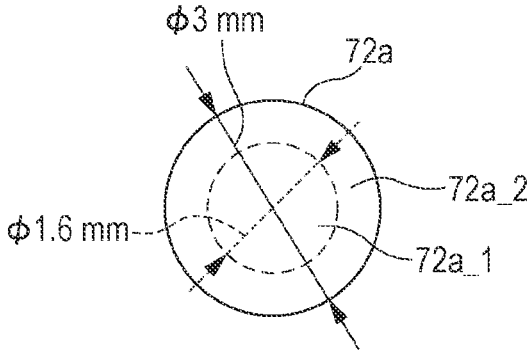

FIGS. 5A and 5B are illustrations explaining an experiment for determining the width of each of the two arms included in a toner pattern.

As shown in FIG. 5A, this experiment uses a single strip-like C-color toner pattern that is inclined by 27° with respect to an up-down direction in the figure. The up-down direction in FIG. 5A corresponds to the left-right direction in FIG. 3A.

Also, this experiment uses 14 types of toner patterns having widths ranging from 4 to 360 dots (1 dot=42 The 14-type toner patterns are formed on the moving intermediate transfer belt 61 (see FIG. 2) in an array. The light emitting portion 71 of the optical sensor 70 radiates the toner patterns with light, and the light receiving portion 72 receives reflected light. FIG. 5A illustrates a graph G2 indicative of an output signal from the light receiving portion 72 at this time, in association with the array of the 14-type toner patterns. In the graph G2, the vertical axis plots a level (voltage) of the output signal from the light receiving portion 72 and the horizontal axis plots a time. The graph G2 illustrates a third line L3 indicative of the output signal from the light receiving portion 72.

When the intermediate transfer belt 61 moves in the moving direction indicated by the arrow C, the spot SP of the emitted light from the light emitting portion 71 passes across the 14-type toner patterns in order from the pattern with a small width.

Since the reflectance by specular reflection at a toner image is lower than the reflectance by specular reflection at the surface of the intermediate transfer belt 61, when the spot SP of the emitted light passes across the 14-type toner patterns, the level of the output signal of the light receiving portion 72 decreases. As it is found from the third line L3, the larger the width of the toner pattern, the larger the decrease amount of the level. However, the decrease in level may be restricted if the width of the toner pattern becomes too large.

In general, reflected light reflected by a toner image includes reflected light that is reflected while being diffused at the surface of the toner image and spreading around (diffused reflected light), in addition to reflected light that is reflected by specular reflection at the surface of the toner image (specular reflected light).

As schematically illustrated in FIG. 5B, the light receiving portion 72 according to the first exemplary embodiment has a circular light receiving surface 72*a* with an outer diameter of 3 mm. In contrast, the spot SP of the emitted light from the light emitting portion 71 has a circular shape with an outer diameter of about 1.6 mm. The specular reflected light from the surface of the intermediate transfer belt 61 and the surface of the toner image is received by an area (specular reflection effective area) 72*a*_1 with an outer diameter of 1.6 mm arranged at the inner side of the light receiving surface 72*a*. The diffused reflected light from the surface of the toner image is also incident on the specular reflection effective area 72*a*_1. Since the diffused reflected light is light that is spread as compared with the specular reflected light, the diffused reflected light is also incident on an area outside the specular reflection effective area 72*a*_1. The area outside the specular reflection effective area 72*a*_1 is an area on which only the diffused reflected light is incident. Hereinafter, the outside area is referred to as diffused reflection effective area 72*a*_2.

If the width of the toner pattern shown in FIG. 5A is sufficiently smaller than the specular reflection effective area 72*a*_1, the larger the width, the less the specular reflected light. In contrast, the larger the width, the more the diffused reflected light. However, if the width of the toner pattern is sufficiently smaller than the specular reflection effective area 72*a*_1, the diffused reflected light is almost negligible. Hence, if the width of the toner pattern is equal to or smaller than the specular reflection effective area 72*a*_1, the larger the width, the larger the decrease amount of the level of the output signal from the light receiving portion 72. However, if the width of the toner pattern becomes a certain width or larger, the diffused reflected light becomes non-negligibly large with respect to the decrease amount of the specular reflected light. Consequently, if the width of the toner pattern becomes a certain width or larger, the larger the width, the smaller the decrease amount of the level of the output signal from the light receiving portion 72.

Figure 6:
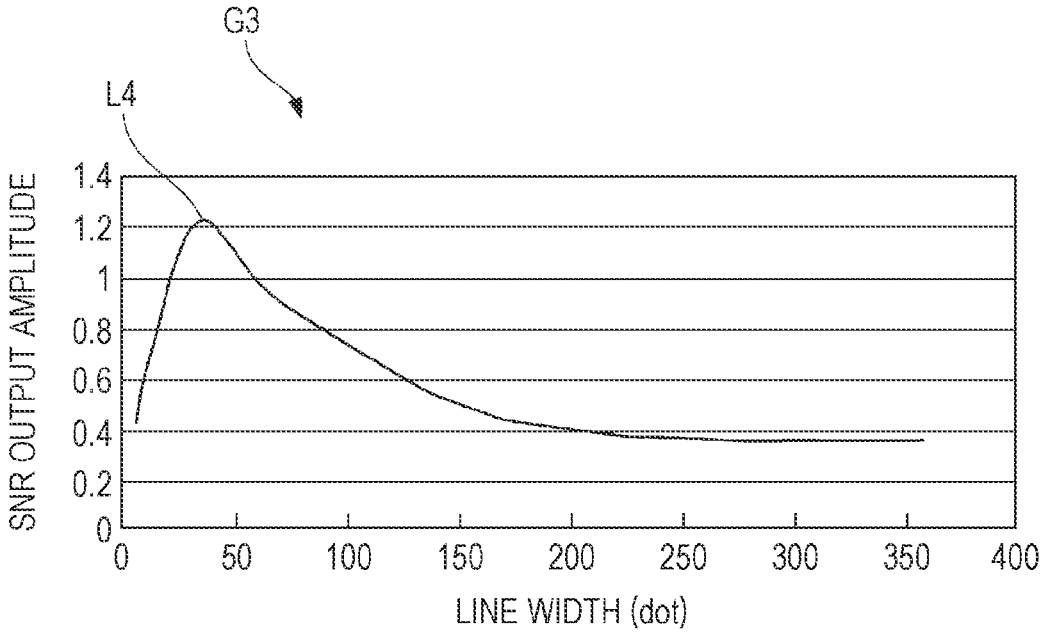
FIG. 6 is a graph showing the relationship between a width of the toner pattern and a decrease amount of the level of an output signal from a light receiving portion.

FIG. 6 is a graph showing the relationship between the width of the toner pattern and the decrease amount of the level of the output signal from the light receiving portion.

In a graph G3 of FIG. 6, the vertical axis plots a decrease amount of the level of the output signal from the light receiving portion 72 and the vertical axis plots a width of the toner pattern. The graph G3 illustrates a fourth line L4 indicative of a change in decrease amount of the level of the output signal from the light receiving portion 72 with respect to an increase in the width of the toner pattern.

As it is found from the fourth line L4, the decrease amount of the level of the output signal from the light receiving portion 72 becomes the largest when the width of the toner pattern is in a range from 35 to 40 dots equivalent to the outer diameter of the specular reflection effective area 72*a*_1 shown in FIG. 5B.

In the first exemplary embodiment, as described above with reference to FIGS. 3A to 3C, the output signal from the light receiving portion 72 is binarized and converted into a pulsed signal. For such conversion processing, it is desirable if the decrease amount of the level of the output signal is large.

The above-described experiment is performed by using the C-color toner pattern. However, the relationship between the width of the toner pattern and the decrease amount of the level of the output signal from the light receiving portion is common to the toner patterns of two YM colors. For the K-color toner pattern, since the K-color toner pattern originally has a very low spectral reflectance, the effect of the diffused reflected light is almost negligible regardless of the width of the toner pattern. Owing to this, for the K-color toner pattern, the decrease amount of the level of the output signal from the light receiving portion becomes almost constant if the width of the toner pattern becomes larger than the outer diameter of the specular reflection effective area 72*a*_1.

Therefore, in the first exemplary embodiment, the width of each of the two arms included in each of the toner patterns of YMCK colors employs 40 dots with which the decrease amount of the level of the output signal becomes the largest for either color.

Herein, a registration mark according to a comparative example and an experiment using the registration mark according to the comparative example will be described for comparison with the registration mark 100 according to the first exemplary embodiment.

The registration mark according to the comparative example is similar to the registration mark 100 according to the first exemplary embodiment except that each of toner patterns of YMCK colors is a single-color toner pattern in which a toner of only a single color is uniformly distributed.

In the experiment using the registration mark according to the comparative example, the registration mark of the comparative example is formed on the moving intermediate transfer belt 61 (see FIG. 2), the light emitting portion 71 of the optical sensor 70 radiates the registration mark with light, and the light receiving portion 72 receives reflected light.

Figure 7:
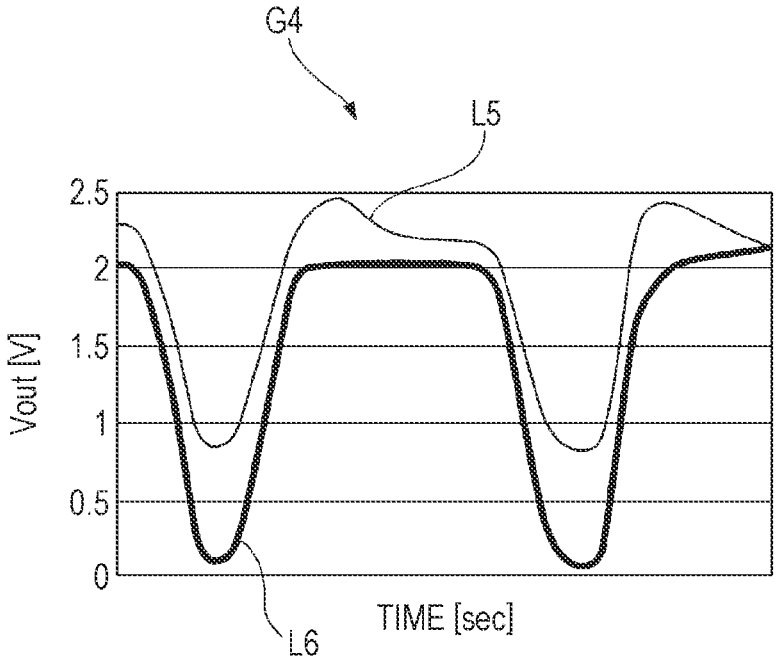
FIG. 7 is a graph showing an output signal from the light receiving portion acquired through an experiment using a registration mark of a comparative example.

FIG. 7 is a graph showing an output signal from the light receiving portion acquired through an experiment using the registration mark of the comparative example.

In a graph G4 of FIG. 7, the vertical axis plots a level (voltage) of the output signal from the light receiving portion 72 and the horizontal axis plots a time. The graph G4 illustrates a fifth line L5 indicative of an output signal acquired for a C-color toner pattern and a sixth line L6 indicative of an output signal acquired for a K-color toner pattern.

In the graph G4, the time axis of the fifth line L5 is shifted so that a position at which the signal level decreases is almost aligned with a position at which the signal level decreases in the sixth line L6.

As it is found from the graph G4, the waveform of the output signal acquired for the K-color toner pattern is not aligned with the waveform of the output signal acquired for the C-color toner pattern. To be more specific, the decrease amount of the level of the output signal acquired for the K-color toner pattern is larger than the decrease amount of the level of the output signal acquired for the C-color toner pattern.

Regarding the K-color toner pattern, the amount of diffused reflected light is very small as described above, and a decrease in specular reflected light when the spot SP of the light emitted from the light emitting portion 71 passes across the toner pattern appears substantially directly as a decrease in level of the output signal from the light receiving portion 72.

In contrast, regarding the C-color toner pattern, since the diffused reflected light is received by the light receiving portion 72 even if the specular reflected light decreases when the spot SP of the light passes across the toner pattern, the decrease amount of the level of the output signal from the light receiving portion 72 is smaller than that of the K-color toner pattern.

Also, regarding either of the Y-color and M-color toner patterns, the decrease amount of the level of the output signal from the light receiving portion 72 becomes smaller than that of the K-color toner pattern by the effect of the diffused reflected light like the C-color toner pattern.

As described above, the adjustment values for the registration processing are acquired by using Expression (1) and Expression (2). These expressions use the pulse intervals T1 to T5 in the pulsed signal shown in FIG. 3C and acquired by binarizing the output signal from the light receiving portion 72.

The values L and P indicative of the positional shift amounts in the main-scanning direction and sub-scanning direction calculated by these expressions become "0" if the waveform of the output signal of K color is aligned with each of the waveforms of the output signals of YMC colors and hence the toner-image formation positions of the respective colors are not shifted from each other. In such a case, the adjustment values stored currently on the memory are continuously used for the next registration processing.

As shown in the graph G4 of FIG. 7, if the waveform of the output signal of K color is not aligned with each of the waveforms of the output signals of YMC colors, the pulse intervals T1 to T5 may likely vary. A variation in the pulse intervals T1 to T5 may gives a certain value (offset value) to the values L and P indicative of the positional shift amounts in the main-scanning direction and sub-scanning direction, even if the toner-image formation positions of the respective colors are not shifted from each other. The offset value may possibly become larger as the difference between the waveform of the output signal of K color and each of the waveforms of the output signals of YMC colors is larger. If the offset value is large, accuracy of positional shift correction for the toner-image formation positions by the registration processing may be degraded.

As long as the registration mark including the toner patterns with the pattern structures as shown in FIG. 3A is used, as compared with the aforementioned comparative example, it is ensured by the following experiment that the difference between the waveform of the output signal of K color and each of the waveforms of the output signals of YMC colors decreases.

Each of the toner patterns of YMCK colors included in the registration mark for the experiment has an arrowhead-like shape like the toner patterns 101Y, 101M, 101C, and 101K according to the first exemplary embodiment shown in FIG. 3A. Each of the toner patterns of the YMCK colors included in the registration mark for the experiment has a pattern structure as follows.

Figure 8:
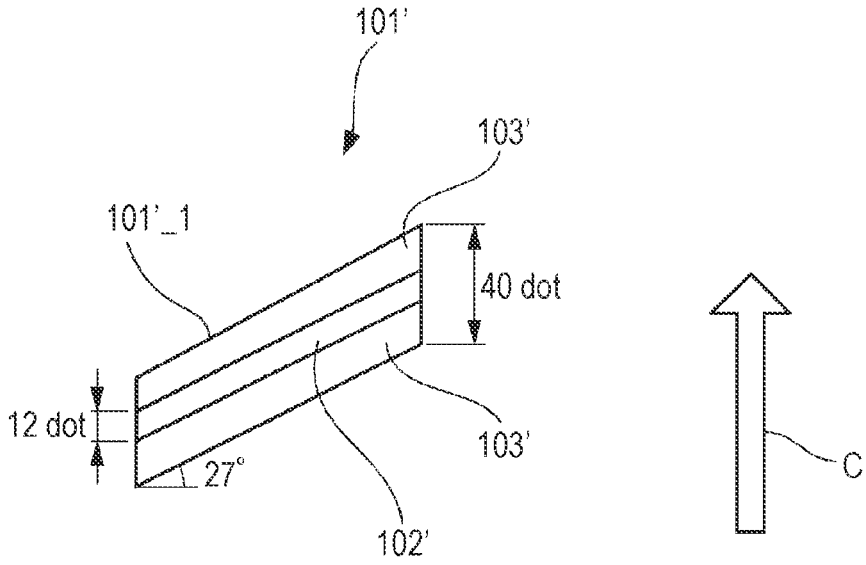
FIG. 8 is a schematic illustration showing a pattern structure of a toner pattern included in a registration mark for an experiment.

FIG. 8 is a schematic illustration showing the pattern structure of the toner pattern included in the registration mark for the experiment.

FIG. 8 schematically illustrates an arm 101'_1 from among two arms of a toner pattern 101' included in the registration mark for the experiment. The toner patterns of YMCK colors included in the registration mark for the experiment have equivalent pattern structures. FIG. 8 illustrates the toner pattern 101' without distinction of colors.

As shown in FIG. 8, the arm 101'_1 is inclined by 27° with respect to the left-right direction in the figure and has a width of 40 dots like the arms of the toner patterns 101Y, 101M, 101C, and 101K according to the first exemplary embodiment shown in FIG. 3A.

The toner pattern 101' for the experiment including the arm 101'_1 has an inner pattern 102' with a width of 12 dots and outer patterns 103'. The outer patterns 103' are arranged on both sides of the inner pattern 102' in the moving direction of the intermediate transfer belt 61 (see FIG. 2) indicated by the arrow C without a gap with respect to the inner pattern 102'.

Like the K-color toner pattern 101K according to the first exemplary embodiment shown in FIG. 3A, in a K-color toner pattern 101' for the experiment, an inner pattern 102' is formed with the C-color toner and outer patterns are formed with the K-color toner. Also, in each of toner patterns 101' of YMC colors for the experiment, an inner pattern 102' is formed with the K-color toner and outer patterns are formed with a toner of each of YMC colors.

The inner patterns 102Y, 102M, 102C, and 102K of the toner patterns 101Y, 101M, 101C, and 101K according to the first exemplary embodiment shown in FIG. 3A each have a larger width than the width of the inner pattern 102' of the toner pattern 101' for the experiment. The widths of the inner patterns 102Y, 102M, 102C, and 102K of the toner patterns 101Y, 101M, 101C, and 101K according to the first exemplary embodiment will be described later in detail.

In the experiment using the registration mark for the experiment, the registration mark for the experiment is formed on the moving intermediate transfer belt 61 (see FIG. 2), the light emitting portion 71 of the optical sensor 70 radiates the registration mark with light, and the light receiving portion 72 receives reflected light.

Figure 9:
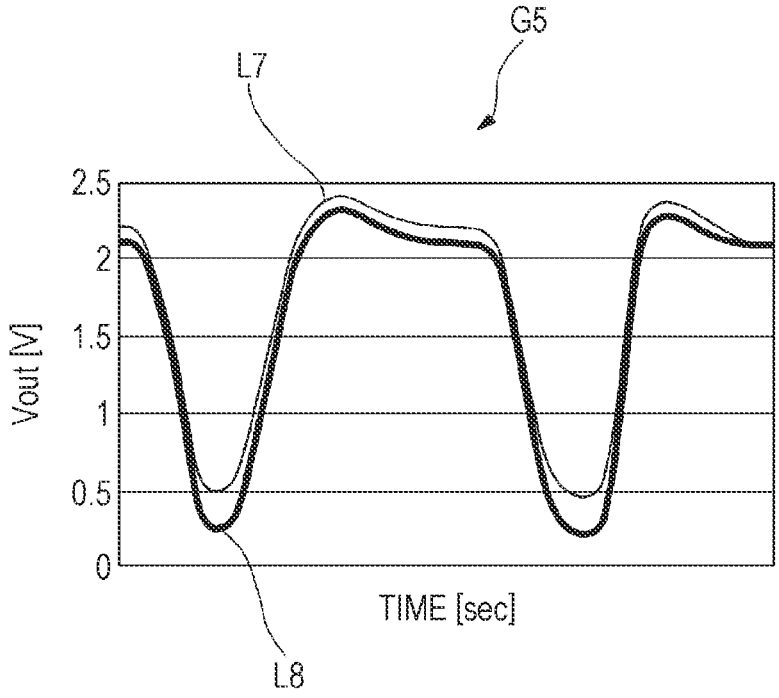
FIG. 9 is a graph showing an output signal from the light receiving portion acquired through the experiment using the registration mark for the experiment.

FIG. 9 is a graph showing an output signal from the light receiving portion acquired through the experiment using the registration mark for the experiment.

In a graph G5 of FIG. 9, the vertical axis plots a level (voltage) of the output signal from the light receiving portion 72 and the horizontal axis plots a time. The graph G5 illustrates a seventh line L7 indicative of an output signal acquired for a C-color toner pattern and an eighth line L8 indicative of an output signal acquired for a K-color toner pattern.

In the graph G5, like the above-described graph G4 of FIG. 7, the time axis of the seventh line L7 is shifted so that a position at which the signal level decreases is almost aligned with a position at which the signal level decreases in the eighth line L8.

As it is found from the graph G5, the difference between the waveform of the output signal acquired for the K-color toner pattern and the waveform of the output signal acquired for the C-color toner pattern is smaller than the difference according to the above-described comparative example.

Regarding the K-color toner pattern, the light receiving portion 72 receives diffused reflected light from the C-color inner pattern, and a decrease in level of the output signal from the light receiving portion 72 when the spot SP of the light emitted from the light emitting portion 71 passes across the toner pattern is restricted as compared with the above-described comparative example. Owing to this, the waveform of the output signal acquired for the K-color toner pattern is close to the waveform of the output signal acquired for each of the toner patterns of YMC colors, as compared with the comparative example.

In the first exemplary embodiment, as shown in FIG. 3A, all the plural K-color toner patterns 101K have the C-color inner patterns 102C formed with the C-color toner. Owing to this, the decrease amount of the level of the output signal from the light receiving portion 72 is common among the plural K-color toner patterns 101K.

Regarding the C-color toner pattern, diffused reflected light is restricted because of the K-color inner pattern, and a decrease in level of the output signal from the light receiving portion 72 when the spot SP of the light emitted from the light emitting portion 71 passes across the toner pattern is large as compared with the above-described comparative example. Owing to this, the waveform of the output signal acquired for the C-color toner pattern is close to the waveform of the output signal acquired for the K-color toner pattern, as compared with the comparative example.

Also, regarding the Y-color and M-color toner patterns, like the C-color toner pattern, diffused reflected light is restricted because of the K-color inner pattern, and a decrease in level of the output signal from the light receiving portion 72 is larger than that of the comparative example. Owing to this, the waveform of the output signal acquired for each of the Y-color and M-color toner patterns is close to the waveform of the output signal acquired for the K-color toner pattern, as compared with the comparative example.

As described above, the difference between the waveform of the output signal acquired for the K-color toner pattern and the waveform of the output signal acquired for each of the toner patterns of YMC colors for the experiment is smaller than the difference according to the above-described comparative example.

The waveform of the output signal acquired for the K-color toner pattern becomes close to the waveform of the output signal acquired for each of the toner patterns of YMC colors as the width of the C-color inner pattern increases and hence the amount of diffused reflected light increases. Also, the waveform of the output signal acquired for each of the toner patterns of YMC colors becomes close to the waveform of the output signal acquired for the K-color toner pattern as the width of the K-color inner pattern increases and hence the amount of diffused reflected light decreases. However, if the width of the inner pattern becomes too large, the inner pattern may protrude when formation positions of the inner and outer patterns have an error.

The widths of the inner patterns 102Y, 102M, 102C, and 102K of the toner patterns 101Y, 101M, 101C, and 101K of YMCK colors according to the first exemplary embodiment shown in FIG. 3A are as large widths as possible within a range that does not cause the above-mentioned protrusion. In particular, the widths are determined as follows.

Figure 10A:
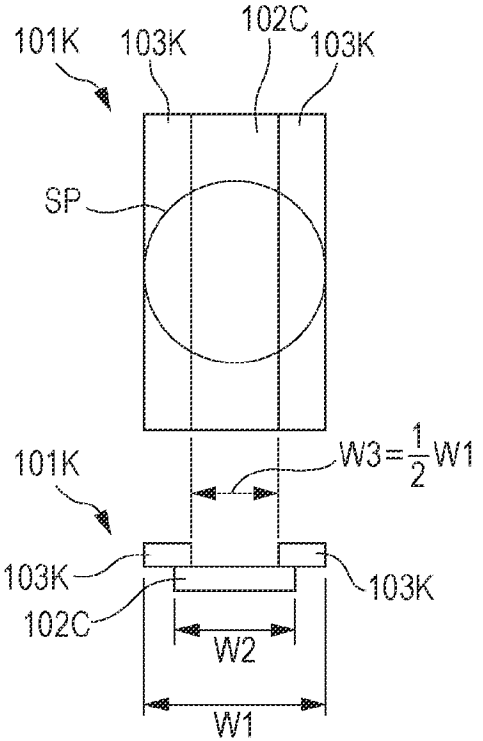
FIGS. 10A to 10C are illustrations schematically showing a desirable range for a width of a C-color inner pattern included in a K-color toner pattern.
Figure 10B:
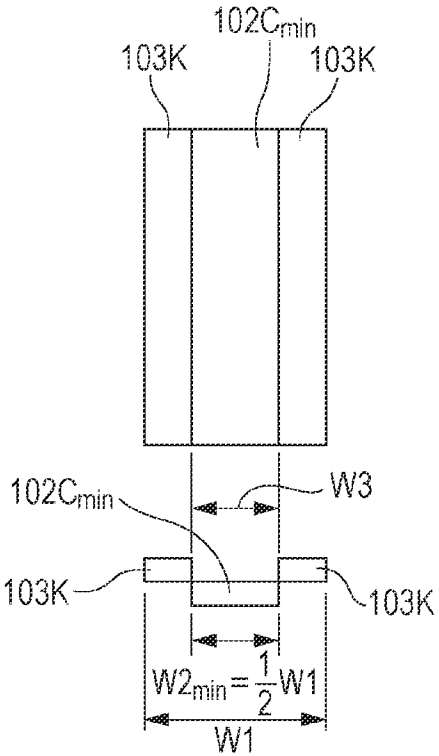
Figure 10C:
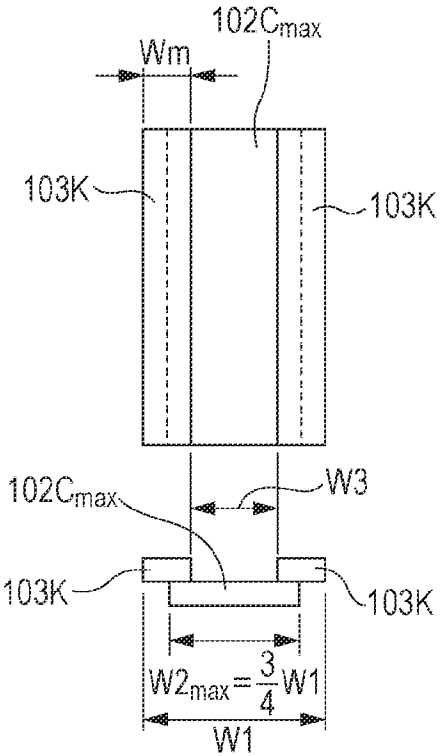

FIGS. 10A to 10C are illustrations schematically showing a desirable range for a width of the C-color inner pattern included in the K-color toner pattern.

FIGS. 10A to 10C each schematically illustrate one of two arms included in the K-color toner pattern 101K. For convenience of description, FIGS. 10A to 10C each illustrate a single arm without the inclination by 27° shown in FIGS. 3A and 8. This point is also applied to FIGS. 11A to 11C described later.

As described above, the widths of the toner patterns 101Y, 101M, 101C, and 101K of YMCK colors according to the first exemplary embodiments are each desirably in a range from 35 to 40 dots, which is substantially equivalent to the outer diameter of the specular reflection effective area 72*a*_1 shown in FIG. 5B. In the first exemplary embodiment, the toner patterns 101Y, 101M, 101C, and 101K of YMCK colors employ the width of 40 dots.

FIG. 10A schematically illustrates that the width of the K-color toner pattern 101K is substantially equivalent to the outer diameter of the specular reflection effective area 72*a*_1, i.e., the spot SP of the light emitted from the light emitting portion 71.

Also, in the first exemplary embodiment, as shown in FIG. 2, the toner images are transferred on the intermediate transfer belt 61 in order of Y color, M color, C color, and K color. Owing to this, as shown in FIG. 10A, the K-color toner pattern 101K is formed such that the K-color outer patterns 103K is transferred onto the C-color inner pattern 102C. Also, the K-color outer patterns 103K are patterns that have a gap through which the C-color inner pattern 102C is exposed. In the K-color toner pattern 101K, a width of a portion of the C-color inner pattern 102C that promotes diffused reflection corresponds to a width W3 of the gap between the K-color outer patterns 103K.

In the first exemplary embodiment, a decrease in level of the output signal is restricted for the K-color toner pattern 101K because of the C-color inner pattern 102C. In contrast, a decrease in level of the output signal of each of the toner patterns 101Y, 101M, and 101C of YMC colors is promoted because of the K-color inner pattern 102K. For alignment of both the waveforms, it is desirable to balance the restriction of a decrease in level of the output signal for K color and the promotion of a decrease in level of the output signal for each of YMC colors. Hence, in the first exemplary embodiment, the width W3 of the gap between the outer patterns 103K of the K-color toner pattern 101K employs ½ of a width W1 of the toner pattern 101K.

Also, a minimum width W2 min of the inner pattern 102C is ½ of the width W1 of the toner pattern 101K, which is the same as the width W3 of the gap between the outer patterns 103K. FIG. 10B illustrates a K-color toner pattern 101K having an inner pattern 102$C_{min}$ with the minimum width W2$_{min}$.

Also, a maximum width W2$_{max}$ of the inner pattern 102C employs ¾ of the width W1 of the toner pattern 101K so that the inner pattern 102C does not protrude due to an error of formation positions of the inner pattern 102C and the outer patterns 103K. FIG. 100 illustrates a K-color toner pattern 101K having an inner pattern 102$C_{max}$ with the maximum width W2$_{max}$. In the case of the maximum width W2$_{max}$, a margin width Wm for a shift of the inner pattern 102C is ¼ of the width W1 of the toner pattern 101K.

Figure 11A:
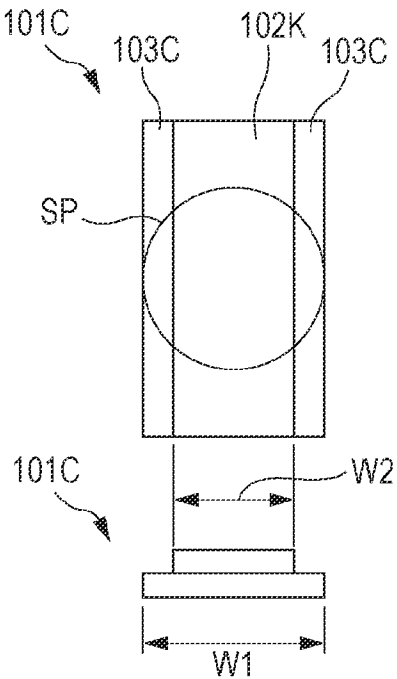
FIGS. 11A to 11C are illustrations schematically showing a desirable range for a width of a K-color inner pattern included in each of toner patterns of YMC colors.
Figure 11B:
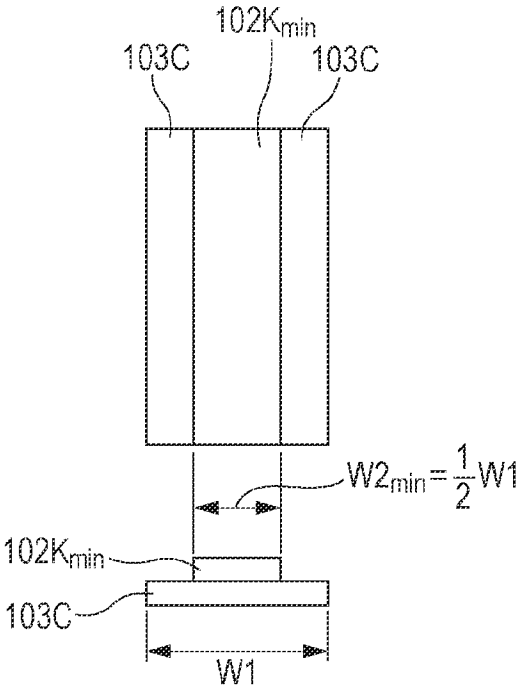
Figure 11C:
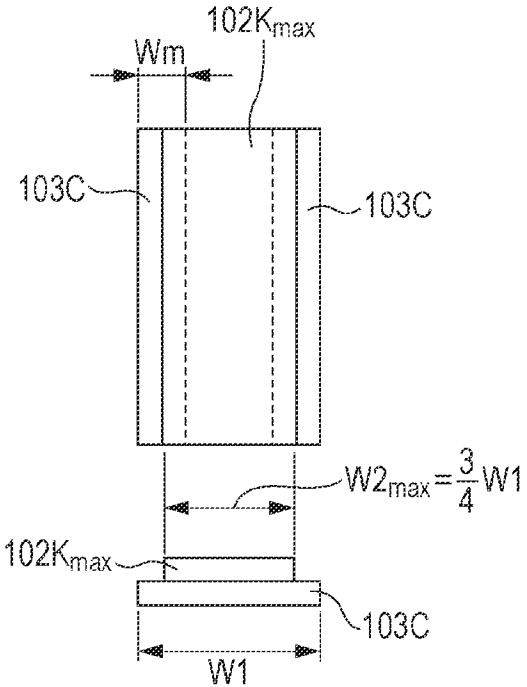

FIGS. 11A to 11C are illustrations schematically showing a desirable range for a width of the K-color inner pattern included in each of the toner patterns of YMC colors. FIGS. 11A to 11C each illustrate a C-color toner pattern 101C as a representative example.

FIG. 11A schematically illustrates that the width of the C-color toner pattern 101C is substantially equivalent to the outer diameter of the specular reflection effective area 72*a*_1.

In the first exemplary embodiment, the C-color toner pattern 101C is formed such that the K-color inner pattern 102K is transferred onto the C-color outer pattern 103C as shown in FIG. 11A according to the transfer order on the intermediate transfer belt 61 (see FIG. 2).

In the C-color toner pattern 101C, the entire K-color inner pattern 102K restricts diffused reflection.

To balance the restriction of a decrease in level of the output signal for K color and the promotion of a decrease in level of the output signal for each of YMC colors, the width of the K-color inner pattern 102K employs a width W2 in a range from the minimum width W2$_{min}$, to the maximum width W2$_{max}$ mentioned above.

Also, protrusion of the inner pattern 102K due to an error of the formation positions of the inner pattern 102K and the outer pattern 103C is prevented because the width W2 is employed.

FIG. 11B illustrates a C-color toner pattern 101C having an inner pattern 102$K_{min}$ with the minimum width W2$_{min}$. FIG. 11C illustrates a C-color toner pattern 101C having an inner pattern 102$K_{max}$ with the maximum width W2$_{max}$.

Next, a second exemplary embodiment is described.

This second exemplary embodiment differs from the first exemplary embodiment for a registration mark. The registration mark of the second exemplary embodiment is described below.

An image forming apparatus of the second exemplary embodiment is similar to the image forming apparatus (the copier 1) of the first exemplary embodiment shown in FIGS. 1 and 2. Hence, the description of the image forming apparatus is omitted.

Figure 12:
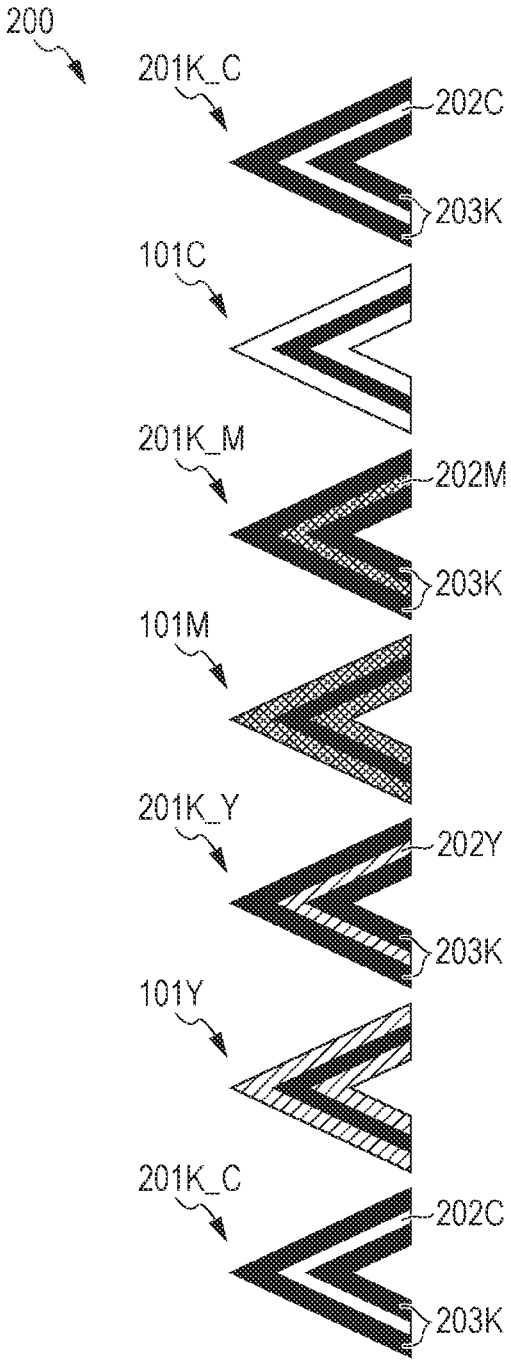
FIG. 12 is an illustration showing a registration mark according to a second exemplary embodiment.

FIG. 12 is an illustration showing a registration mark according to the second exemplary embodiment.

In FIG. 12, toner patterns of YMC colors equivalent to those of the registration mark 100 according to the first exemplary embodiment shown in FIG. 3A refer the same reference signs in FIG. 3A. In the following description, redundant description for such toner patterns of YMC colors is omitted.

A registration mark 200 shown in FIG. 12 includes three types of K-color toner patterns 201K_Y, 201K_M, and 201K_C having inner patterns with mutually different colors.

The first K-color toner pattern 201K_Y includes an inner pattern 202Y formed with the Y-color toner and outer patterns 203K formed with the K-color toner. The second K-color toner pattern 201K_M includes an inner pattern 202M formed with the M-color toner and outer patterns 203K formed with the K-color toner. The third K-color toner pattern 201K_C includes an inner pattern 202C formed with the C-color toner and outer patterns 203K formed with the K-color toner.

In the second exemplary embodiment, the inner patterns 202Y, 202M, and 203C of YMC colors each correspond to an example of a first pattern. The K-color outer pattern 203K corresponds to an example of a second pattern.

As shown in FIG. 4, a toner image of any of YMC colors has a higher spectral reflectance than a toner image of K color with respect to light with a wavelength of 940 nm emitted on the registration mark 200. Hence, a decrease in level of an output signal of any of the three-type K-color toner patterns 201K_Y, 201K_M, and 201K_C is restricted. The waveform of the output signal of any of the three-type K-color toner patters 201K_Y, 201K_M, and 201K_C becomes close to each of the waveforms of toner patterns of YMC colors.

Further, in the registration mark 200, the toners with different colors are used for formation of the inner patterns of the three-type K-color toner patterns 201K_Y, 201K_M, and 201K_C. Thus, toner consumption is restricted.

Next, a third exemplary embodiment is described.

The third exemplary embodiment differs from the first exemplary embodiment for a registration mark and a wavelength of light emitted on the registration mark. The registration mark of the third exemplary embodiment is particularly described below.

In the third exemplary embodiment, the wavelength of light emitted on the registration mark is 680 nm.

As shown in FIG. 4, spectral reflectances of toners of two YM colors are relatively high and spectral reflectances of toners of two CK colors are relatively low with respect to the light with the wavelength of 680 nm. In the third exemplary embodiment, the toners of two YM colors each correspond to an example of a toner that belongs to a high-reflectance group. The remaining toners of two CK colors each correspond to an example of a toner that belongs to a low-reflectance group.

An image forming apparatus of the third exemplary embodiment is similar to the image forming apparatus (the copier 1) of the first exemplary embodiment shown in FIGS. 1 and 2 except for the above-mentioned wavelength of light. Hence, the description of the image forming apparatus is omitted.

Figure 13:
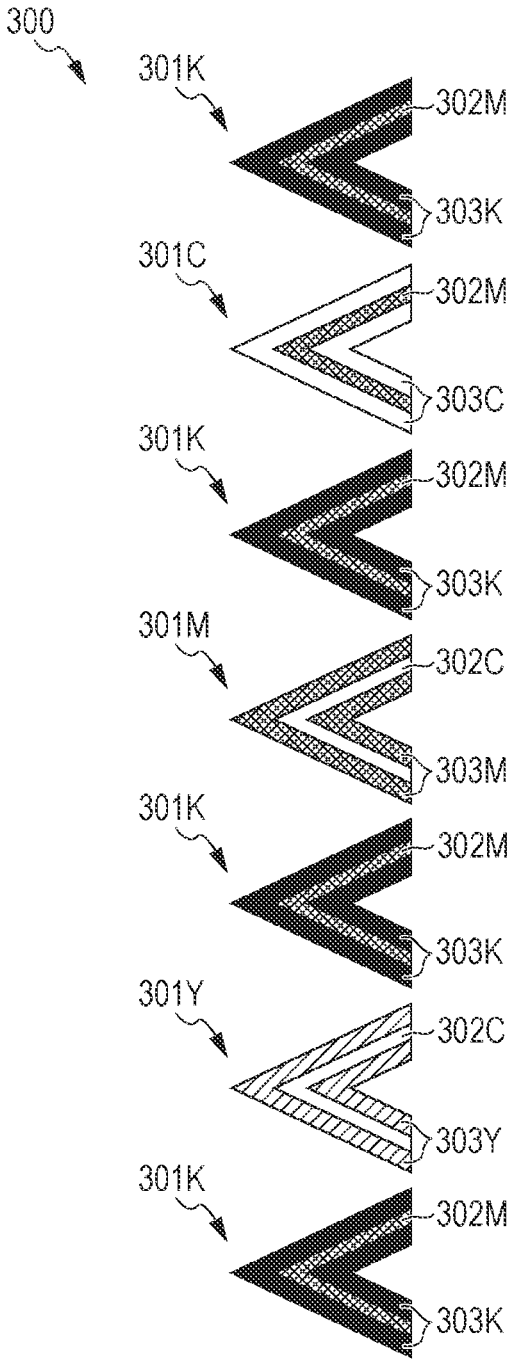
FIG. 13 is an illustration showing a registration mark according to a third exemplary embodiment.

FIG. 13 is an illustration showing a registration mark according to the third exemplary embodiment.

A registration mark 300 according to the third exemplary embodiment includes toner patterns 301Y, 301M, 301C, and 301K of YMCK colors.

The toner patterns 301C, 301M, 301Y, and 301K of YMCK colors according to the third exemplary embodiment have shapes equivalent to the toner patterns 101Y, 101M, 101C, and 101K of YMCK colors according to the first exemplary embodiment shown in FIG. 3A.

The toner patterns 301C, 301M, 301Y, and 301K of YMCK colors according to the third exemplary embodiment are arranged equivalently to arrangement of the toner patterns 101Y, 101M, 101C, and 101K of YMCK colors according to the first exemplary embodiment shown in FIG. 3A.

The C-color toner pattern 301C includes an inner pattern 302M formed with the M-color toner and an outer pattern 303C formed with the C-color toner. Also, the K-color toner pattern 301K includes an inner pattern 302M formed with the M-color toner and outer patterns 303K formed with the K-color toner.

In the third exemplary embodiment, the M-color inner pattern 302M corresponds to an example of a first pattern, and the outer patterns 303C and 303K of two CK colors each correspond to an example of a second pattern.

Also, the Y-color toner pattern 301Y includes an inner pattern 302C formed with the C-color toner and an outer pattern 303Y formed with the Y-color toner. Also, the M-color toner pattern 301M includes an inner pattern 302C formed with the C-color toner and an outer pattern 303M formed with the M-color toner.

In the third exemplary embodiment, the C-color inner pattern 302C corresponds to an example of a third pattern, and the outer patterns 303Y and 303M of two YM colors each correspond to an example of a fourth pattern.

In the third exemplary embodiment, as described above, the toners of two CK colors have the relatively low spectral reflectances and the toners of two YM colors have the relatively high spectral reflectances with respect to the light emitted from the light emitting portion 71 (see FIG. 2).

Hence, in the third exemplary embodiment, regarding the toner patterns 301C and 301K of two CK colors, a decrease in level of an output signal is restricted because of diffused reflection from the M-color inner pattern 302M. Accordingly, the waveform of the output signal of each of the toner patterns 301C and 301K of two CK colors becomes close to the waveform of the output signal of each of the toner patterns 301Y and 301M of YM colors.

Also, regarding the toner patterns 301Y and 301M of two YM colors, a decrease in level of the output signal is promoted because the C-color inner pattern 302C restricts diffused reflection. Accordingly, the waveform of the output signal of each of the toner patterns 301Y and 301M of two YM colors becomes close to the waveform of the output signal of each of the toner patterns 301C and 301K of CK colors.

In the third exemplary embodiment, any of the toner patterns 301Y and 301M of two YM colors has the C-color inner pattern 302C. Alternatively, one of the toner patterns of two YM colors may have the C-color inner pattern and the other may have the K-color inner pattern.

In the third exemplary embodiment, the emitted light has the wavelength of 680 nm and the spectral reflectances of the toners of two CK colors are low, and the C-color inner pattern 302C is used as the inner pattern of each of the toner patterns 301Y and 301M of two YM colors. It is to be noted that the K-color toner has a low spectral reflectance regardless of the wavelength of the emitted light as shown in FIG. 4. That is, the K-color toner may be used as a toner for an inner pattern of a toner pattern including outer patterns formed with a toner with a high spectral reflectance in an image forming apparatus provided with any type of optical sensor.

In the third exemplary embodiment, any of the toner patterns 301C and 301K of two CK colors has the M-color inner pattern 302M. Alternatively, one of the toner patterns of two CK colors may have the M-color inner pattern and the other may have the Y-color inner pattern.

In any of the first to third exemplary embodiments, the light emitting portion 71 (see FIG. 2) emits the light with the wavelength of 940 nm or the light with the wavelength of 680 nm. Alternatively, the wavelength of light emitted form the light emitting portion 71 (see FIG. 2) may be any wavelength as long as toners with plural colors used in the image forming apparatus may be divided into two groups in accordance with high and low levels of spectral reflectances with respect to the light.

In any of the first to third exemplary embodiments, the toners of four YMCK colors are exemplified as toners of plural colors. However, the toners with plural colors may be toners of five or more colors by adding a toner of another color to the toners of the four colors.

In any of the first to third exemplary embodiments, the color copier 1 is exemplified as the image forming apparatus. Alternatively, the image forming apparatus may be, for example, a color printer or a color facsimile.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A registration mark comprising:

a set of toner patterns that are formed on a transferred member, which moves along a plurality of toner-image forming units respectively using toners of a plurality of colors and forming a plurality of toner images of different colors, wherein the transfer member receives transfer of the plurality of toner images formed by the plurality of toner-image forming units, wherein the set of toner patterns provides information of toner-image formation positions of the plurality of toner-image forming units to an optical sensor that emits light and receives reflected light, wherein the toners of the plurality of colors comprise a low-reflectance group having a relatively low spectral reflectance and a high-reflectance group having a relatively high spectral reflectance with respect to the light emitted by the optical sensor, wherein the set of toner patterns comprises:

a first pattern in which the toner that belongs to the high-reflectance group is distributed without a gap in a moving direction of the transferred member; and second patterns formed with the toner that belongs to the low reflectance group, the second patterns being arranged on both sides of the first pattern in the moving direction of the transferred member without any gap between the first pattern and the second patterns.

2. The registration mark according to claim 1, wherein the set of toner patterns further comprises:

a third pattern in which the toner that belongs to the low-reflectance group is distributed without a gap in the moving direction of the transferred member; and fourth patterns formed with the toner that belongs to the high-reflectance group, the fourth patterns being arranged on both sides of the third pattern in the moving direction of the transferred member without any gap between the third pattern and the fourth patterns.

3. The registration mark according to claim 2, wherein the low-reflectance group includes a black toner, and wherein the third pattern is formed with the black toner.

4. The registration mark according to claim 1, wherein the set of toner patterns includes a plurality of toner patterns, and wherein each one of the plurality of toner patterns includes the first pattern using toner of a same color.

5. An image forming apparatus comprising:

a plurality of toner-image forming units that respectively use toners of a plurality of colors and form a plurality of toner images of different colors;

a transferred member that moves along the plurality of toner-image forming units and receives transfer of the plurality of toner images formed by the plurality of toner-image forming units;

a transfer member that further transfers the toner images of the plurality of colors transferred on the transferred member, onto a recording medium;

a fixing unit that fixes the toner images of the plurality of colors transferred onto the recording medium, to the recording medium;

a mark formation controller that causes the plurality of toner-image forming units to cooperatively form a registration mark including a set of toner patterns for detection of toner-image formation positions of the plurality of toner-image forming units, on the transferred member;

a formation-position detector that includes an optical sensor which radiates the registration mark formed on the transferred member with light and receives reflected light, and that detects the toner-image formation positions of the plurality of toner-image forming units using a signal acquired in response to the optical sensor receiving the reflected light; and a formation-position adjuster that adjusts the toner-image formation positions of the plurality of toner-image forming units using a detection result of the formation-position detector, wherein the toners of the plurality of colors comprise a low-reflectance group having a relatively low spectral reflectance and a high-reflectance group having a relatively high spectral reflectance with respect to the light emitted by the optical sensor, and wherein the mark formation controller controls the set of toner patterns to comprise:

a first pattern in which the toner that belongs to the high-reflectance group is distributed without a gap in a moving direction of the transferred member; and second patterns formed with the toner that belongs to the low-reflectance group, the second patterns being arranged on both sides of the first pattern in the moving direction of the transferred member without any gap between the first pattern and the second patterns.

6. A registration mark comprising:

a set of toner patterns that are formed on a transferred member, which moves along a plurality of toner-image forming units respectively using toners of a plurality of colors and forming a plurality of toner images of different colors and which receives transfer of the plurality of toner images formed by the plurality of toner-image forming units, and that give information of toner-image formation positions of the plurality of toner-image forming units to an optical sensor that emits light and receives reflected light, wherein, when the toners of the plurality of colors are divided into two groups of a low-reflectance group having a relatively low spectral reflectance and a high-reflectance group having a relatively high spectral reflectance in accordance with high and low levels of the spectral reflectances with respect to the light emitted by the optical sensor, the toner pattern that gives the information of the toner-image formation position of the toner-image forming unit using the toner that belongs to the low-reflectance group includes a first pattern in which the toner that belongs to the high-reflectance group is distributed without a gap in a moving direction of the transferred member, and second patterns formed with the toner used by the toner-image forming unit, the second patterns being arranged on both sides of the first pattern in the moving direction of the transferred member without a gap with respect to the first pattern, wherein the toner pattern that gives the information of the toner-image formation position of the toner-image forming unit using the toner that belongs to the high-reflectance group includes:

a third pattern in which the toner that belongs to the low-reflectance group is distributed without a gap in the moving direction of the transferred member, and fourth patterns formed with the toner used by the toner-image forming unit, the fourth patterns being arranged on both sides of the third pattern in the moving direction of the transferred member without a gap with respect to the third pattern, wherein the low-reflectance group includes a black toner, and wherein the third pattern is formed with the black toner.

7. A registration mark comprising:

a set of toner patterns that are formed on a transferred member, which moves along a plurality of toner-image forming units respectively using toners of a plurality of colors and forming a plurality of toner images of different colors and which receives transfer of the plurality of toner images formed by the plurality of toner-image forming units, and that give information of toner-image formation positions of the plurality of toner-image forming units to an optical sensor that emits light and receives reflected light, wherein, when the toners of the plurality of colors are divided into two groups of a low-reflectance group having a relatively low spectral reflectance and a high-reflectance group having a relatively high spectral reflectance in accordance with high and low levels of the spectral reflectances with respect to the light emitted by the optical sensor, the toner pattern that gives the information of the toner-image formation position of the toner-image forming unit using the toner that belongs to the low-reflectance group includes a first pattern in which the toner that belongs to the high-reflectance group is distributed without a gap in a moving direction of the transferred member, and second patterns formed with the toner used by the toner-image forming unit, the second patterns being arranged on both sides of the first pattern in the moving direction of the transferred member without a gap with respect to the first pattern, wherein the toner pattern that gives the information of the toner-image formation position of the toner-image forming unit using the toner that belongs to the low-reflectance group includes a plurality of toner patterns, and wherein the plurality of toner patterns that give the information of the toner-image formation position of the toner-image forming unit using the toner that belongs to the low-reflectance group include the first patterns using the toner of the same color among the plurality of toner patterns.

* * * * *